US011026006B2

(12) United States Patent
Choi

(10) Patent No.: US 11,026,006 B2
(45) Date of Patent: Jun. 1, 2021

(54) PREPARING METHOD OF SPEAKER GRILL FOR VEHICLES

(71) Applicants: HYUNDAI MOTOR COMPANY, Seoul (KR); KIA MOTORS CORPORATION, Seoul (KR)

(72) Inventor: Dong Jae Choi, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/665,283

(22) Filed: Oct. 28, 2019

(65) Prior Publication Data

US 2021/0051383 A1 Feb. 18, 2021

(30) Foreign Application Priority Data

Aug. 14, 2019 (KR) ..... 10-2019-0099352

(51) Int. Cl.
*H04R 1/02* (2006.01)
*H04R 31/00* (2006.01)

(52) U.S. Cl.
CPC ..... *H04R 1/023* (2013.01); *H04R 31/00* (2013.01); *H04R 2499/13* (2013.01)

(58) Field of Classification Search
CPC ..... H04R 1/02; H04R 1/023; H04R 31/00; H04R 2400/13; B06R 11/02; B06R 11/0217; B06R 11/0223
See application file for complete search history.

(56) References Cited

U.S. PATENT DOCUMENTS 10,465,280 B1 11/2019 Choi

FOREIGN PATENT DOCUMENTS

| | | | | |
|---|---|---|---|---|
| JP | 2006211732 | A | * | 8/2006 |
| KR | 101692838 | B1 | * | 1/2017 |
| KR | 101739420 | B1 | * | 5/2017 |
| KR | 10-1778388 | B | | 9/2017 |
| KR | 2019-0124030 | A | | 11/2019 |
| TW | M358503 | U1 | * | 6/2009 |

* cited by examiner

*Primary Examiner* — Thang V Tran
(74) *Attorney, Agent, or Firm* — McDonnell Boehnen Hulbert & Berghoff LLP

(57) ABSTRACT

A method of manufacturing a speaker grill for a vehicle includes coating a coating layer by depositing metal on one side of a steel sheet; pre-etching including forming a first masking layer on one portion of the coating layer, etching the other portion of the coating layer on which the first masking layer is not formed, and removing the first masking layer to form a first etched steel sheet; and performing hole etching including forming a second masking layer on one portion of the first etched steel sheet where the coating layer is present, etching the other portion of the first etched steel sheet on which the second masking layer is not formed, and removing the second masking layer to form a second etched steel sheet, wherein a total area of the first masking layer is smaller than a total area of the second masking layer.

14 Claims, 9 Drawing Sheets

PREPARING METHOD OF SPEAKER GRILL FOR VEHICLES

CROSS-REFERENCE TO RELATED APPLICATION

This application claims the benefit of priority to Korean Patent Application No. 10-2019-0099352, filed in the Korean Intellectual Property Office on Aug. 14, 2019, the entire contents of which are incorporated herein by reference.

TECHNICAL FIELD

The present disclosure relates to a method of manufacturing a speaker grill.

BACKGROUND

A speaker for a vehicle is typically coated to achieve a metallic color. The metallic color can be obtained by coating metal on an outer surface of a speaker. In some implementations, a method of manufacturing the speaker for the vehicle includes giving a specific color to the speaker through a coating method of depositing metal. The related technology is disclosed in Korean Patent No. 1,778,388 (Published Date: Jun. 13, 2017).

The disclosure of this section is to provide background of the invention. Applicant notes that this section may contain information available before this application. However, by providing this section, Applicant does not admit that any information contained in this section constitutes prior art.

SUMMARY

Aspects of the present disclosure relate to a method of manufacturing a speaker grill, which is capable of implementing a variety of texture and colors, has less discoloration due to hole sidewalls to be excellent in appearance characteristics, and lowers roughness of etching grooves to be excellent in touch.

An aspect of the present disclosure provides a method of manufacturing a speaker grill for a vehicle, which is capable of lowering a unit cost of a product by performing a coating in a large amount instead of an individual coating, has less discoloration due to hole sidewalls to be excellent in appearance characteristics, lowers roughness of etching grooves to be excellent in touch, and has smooth spherical etching grooves.

According to an aspect of the present disclosure, a method of manufacturing a speaker grill for a vehicle includes coating a coating layer by depositing metal on one side of a steel sheet; pre-etching including forming a first masking layer on one portion of the coating layer, etching the other portion of the coating layer on which the first masking layer is not formed, and removing the first masking layer to form a first etched steel sheet; and performing hole etching including forming a second masking layer on one portion of the first etched steel sheet where the coating layer is present, etching the other portion of the first etched steel sheet on which the second masking layer is not formed, and removing the second masking layer to form a second etched steel sheet, wherein a total area of the first masking layer is smaller than a total area of the second masking layer.

In addition, the present disclosure provides a speaker grill for a vehicle includes a steel sheet; a coating layer containing metal formed on one side of the steel sheet; and a plurality of etching grooves passing through the coating layer and the steel sheet.

BRIEF DESCRIPTION OF THE DRAWINGS

The above and other aspects, features and advantages of the present disclosure will be more apparent from the following detailed description taken in conjunction with the accompanying drawings.

DETAILED DESCRIPTION

Figure 1:
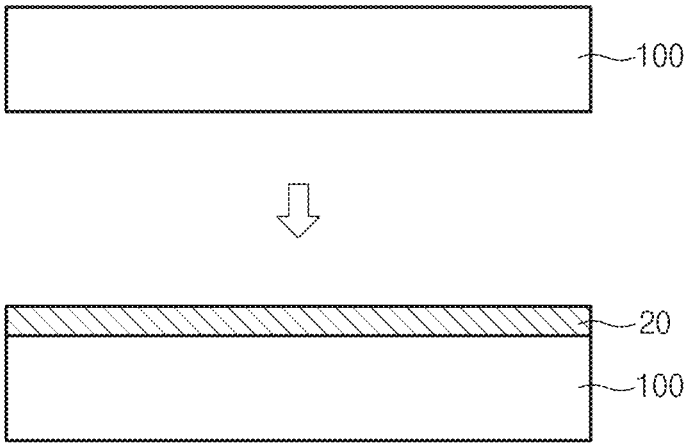
FIG. 1 is a cross-sectional view illustrating a coating operation according to an embodiment of the present disclosure.

Hereinafter, the present disclosure will be described in detail.

In the present disclosure, when any portion "includes" any component, this does not exclude other components but means that any other component may be further included, unless stated otherwise.

In the present disclosure, when any member is located "on" another member, this includes a case in which still another member is present between both members as well as a case in which one member is in contact with another member.

A speaker for a vehicle is typically coated to achieve a metallic color. One of the coating methods includes coating metal on a speaker after manufacturing the speaker. In detail, a method of manufacturing the speaker for the vehicle includes giving a specific color to the speaker through a coating method of depositing titanium carbide (TiC) or the like after partially etching a surface of the speaker to imprint a logo or a brand name.

Here, the method of manufacturing the speaker for the vehicle may include etching a hole after depositing a masking film on a steel sheet and removing the masking film;

forming and processing the etched steel sheet into the speaker grill; depositing and coating metal on the speaker grill; and performing top coating on the coated speaker grill.

However, a foregoing deposition coating method may be expensive due to process characteristics and has a limit in freely selecting design degree of freedom or colors because the deposition coating is applied only to a part which has been processed and etched. Furthermore, in the foregoing speaker coating method, a manufacturing cost is increased, exponentially, as a coating area is increased because speakers are coated one by one.

In an alternative method of manufacturing a stainless steel sheet in which an etching pattern is formed including forming a coating a coating compound including a silane-based compound, an organic acid, a vanadium compound, a magnesium compound, and the residual solvent on the stainless steel sheet to form a coating layer; and a forming a matting coating layer having a plurality of bubbles on the coating layer. However, when the stainless steel sheet having the coating layer formed on the surface thereof is used, it may be impossible to be etched in a typical etching solution. In addition, when the stainless steel sheet on which metal is deposited is etched by the etching solution used, non-uniform holes are formed due to the coating layer and roughness around etching grooves is increased.

Therefore, additional research and development may be needed on a method of manufacturing a speaker for a vehicle, which is capable of lowering a unit cost of a product by performing the coating in a large amount instead of an individual coating, is capable of implementing a variety of textures and colors, has less discoloration due to hole sidewalls to be excellent in appearance characteristics, lowers the roughness of the etching grooves to be excellent in touch, and has smooth spherical etching grooves.

Method of Manufacturing Speaker Grill for Vehicle

A method of manufacturing a speaker grill for a vehicle according to the present disclosure includes coating; pre-etching; and performing hole etching.

Here, in a surface of a stainless steel sheet in which a coating layer is formed, a total area of a first masking layer is smaller than a total area of a second masking layer. During forming the second masking layer, a bottom side of the stainless steel sheet on which a metal coating layer is not formed has a hole etching area greater than a hole etching area of a top side of the steel sheet, thereby minimizing exposure of hole sidewalls.

Coating

Referring to FIG. 1, a stainless steel sheet 10 includes a first surface and a second surface that faces away from the first surface. In embodiments, a coating layer 20 is formed by depositing metal at the first surface of a stainless steel sheet 100. Thus, a variety of colors is implemented at the stainless steel sheet 100

The steel sheet may not be particularly limited as long as the steel sheet is capable of being used in the manufacture of the vehicle speaker grill typically, for example, may include a stainless steel sheet, an aluminum sheet, and the like.

In addition, the steel sheet may include protrusions on a surface. In embodiments, the steel sheet may include the protrusions having specific depth and width by processing the surface of the steel sheet. For example, the processing may be performed through a various methods such as rubbing an abrasive paper on the surface of the steel sheet to form the protrusions, passing the steel sheet between two embossing rolls having a specific shape of emboss to form the protrusions of the emboss-shape on the surface of the steel sheet, hairline processing, sputtering an abrasive on the surface of the steel sheet, or the like, but is not limited thereto.

Further, the steel sheet may be in a form of a roll, but is not limited thereto.

In addition, the deposition may be carried out at a temperature of 60 to 120° C. and a vacuum degree of $1\times10^{-7}$ to $1\times10^{-5}$ torr, specifically, a temperature of 65 to 115° C., or 70 to 110° C. and a vacuum degree of $5\times10^{-7}$ to $5\times^{10-6}$ torr, or $8\times10^{-7}$ to $3\times10^{-6}$ torr. When the temperature during the deposition is within the above range, a density and adhesion of a deposited coating layer may be increased. When the degree of vacuum is within the above range, the coating layer deposited uniformly may be obtained.

For example, the coating layer having an average thickness of 50 to 150 nm may be manufactured using a physical vapor deposition (PVD). When the average thickness of the coating layer is within the above range, the coating layer maintains a decorative color in comparison with a coating layer having a greater thickness than the above thickness and it is easy to etch to implement a speaker hole, a logo, and the like.

In detail, the coating layer may be formed by depositing metal on the first surface of the roll-shaped steel sheet using the physical vapor deposition (PVD). In more detail, the coating layer may be formed by depositing metal by a roll-to-roll process on the first surface of the roll-shaped steel sheet using the PVD.

Here, the physical vapor deposition method may include at least one selected from the group consisting of sputtering, E-beam evaporation, thermal evaporation, laser molecular beam epitaxial (L-MBE), and a pulse laser deposition (PLD).

Figure 2:
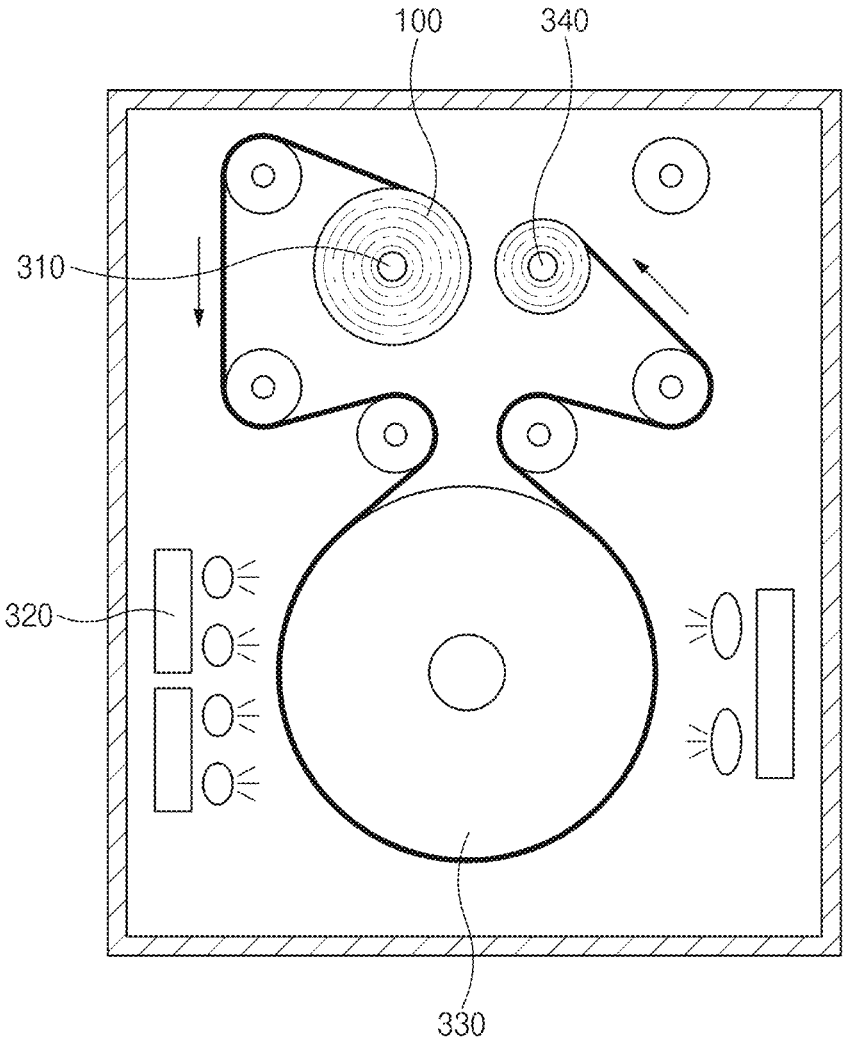
FIG. 2 is a schematic view of forming a coating layer in a coating operation according to an embodiment of the present disclosure.

Referring to FIG. 2, when the roll-shaped steel sheet 100 moving from an unwinding coil 310 to a winding coil 340 rotates along a deposition roll 330, the continuous and uniform coating layer 20 may be formed using a sputter 320. Thus, the coating method as illustrated in FIG. 2 is advantageous for mass production, and the steel sheet 100 in which the coating layer 20 is formed may be cut to a desired size and then may be further processed to make parts of various shapes, which is easily applied to various fields.

In addition, the metal may not be particularly limited as long as the metal is typically a metal which is capable of being deposited on a substrate to exhibit a color and may include, for example, at least one selected from the group consisting of titanium (Ti), chromium (Cr), and zirconium (Zr). Here, the coating layer formed by depositing the metal may be a titanium coating layer such as TiC, TiCN, TiN and TiAlN, a chromium coating layer such as CrN or TiCrN, or a zirconium coating layer such as ZrN or ZrCN.

Pre-Etching

Figure 3:
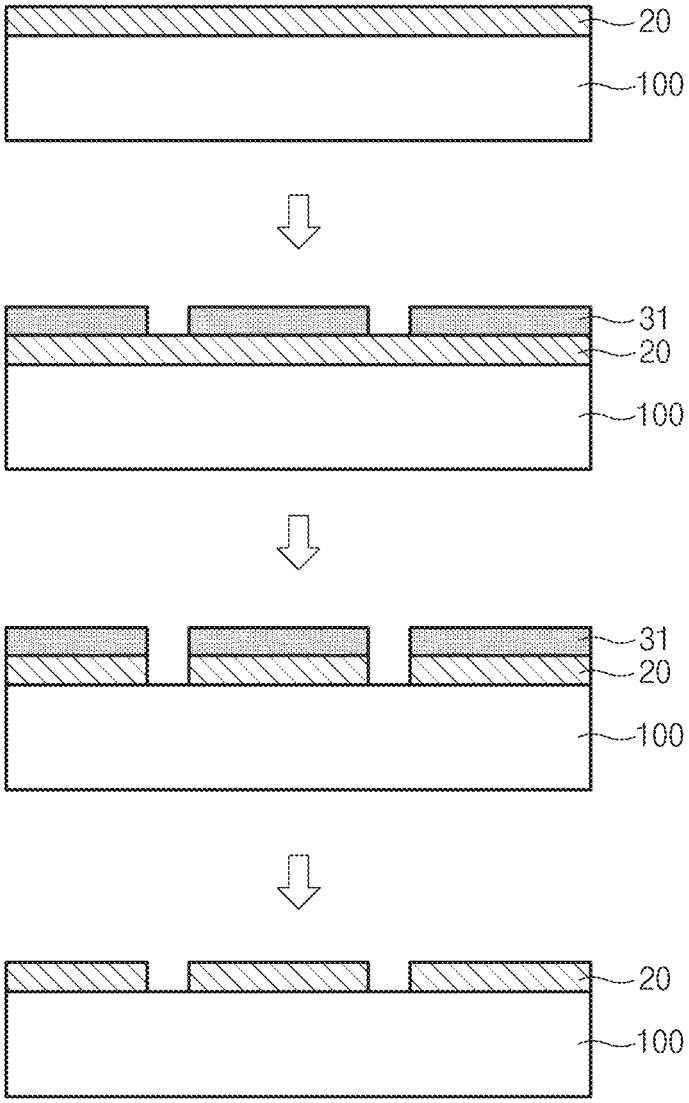
FIG. 3 is a cross-sectional view illustrating a pre-etching operation according to an embodiment of the present disclosure.

Referring to FIG. 3, a first masking layer 31 is formed on one portion of the coating layer 20, the other portion of the coating layer 20 on which the first masking layer 31 is not formed is etched, and the first masking layer 31 is removed to form a first etched steel sheet. The coating layer 20 is not corroded by a general etching solution used for hole etching, and thus, the coating layer 20 on the steel sheet 100 where etching grooves are formed is etched before performing the hole etching. Therefore, the hole etching efficiency is increased.

Here, the first masking layer may be formed using a masking film that is commonly used, for example, may be formed using a photosensitive film. In detail, the photosensitive film is attached on the coating layer, the photosensitive film is irradiated with an ultraviolet light through a mask to remove one portion of the photosensitive film, and thus the photosensitive film remains on the other portion of the coating layer to form the first masking layer. In addition, a surface of the other portion of the coating layer may be exposed by selectively removing the photosensitive film through the mask.

Furthermore, as described above, to selectively remove only one portion of the coating layer on which the first masking layer is not formed and to minimize damage to the first masking layer or the steel sheet, an etching solution including ceric ammonium nitrate (ammonium hexanitrate cerium (IV) acid, $(NH_4)_2[Ce(NO_3)_6]$), water, and a strong acid may be used. The strong acid may include at least one selected from the group consisting of nitric acid ($HNO_3$) and perchloric acid.

For example, the etching may include immersing the steel sheet in the etching solution to etch one portion of the coating layer on which the first masking layer is not formed. In detail, the etching may be to immerse the steel sheet in an etching solution of 30 to 70° C., or 40 to 60° C. for 10 to 100 seconds, 20 to 95 seconds or 30 to 90 seconds. When the temperature of the etching solution during the etching is within the above range, it is possible to avoid or minimize damages of the masking film and further avoid or minimize ineffective removal of the coating layer. In addition, when the immersion time is within the above range, it is possible to avoid or minimize incomplete etching and further avoid and minimize the etching solution's penetrating or permeating between the steel sheet and the masking layer which may cause non-uniformed shape holes.

Here, the etching solution may include ceric ammonium nitrate, strong acid, and water in a weight ratio of 5 to 20:2 to 6:74 to 86, or 8 to 15:3 to 5:80 to 86 by weight. When the weight ratio of ceric ammonium nitrate, strong acid, and water in the etching solution is within the above range, the coating layer may be etched without damaging the steel sheet to increase the efficiency of subsequent hole etching.

Performing Hole Etching

A second masking layer 32 is formed on the other portion where the coating layer 20 exists on the first etched steel sheet, one portion of the steel sheet 100 on which the second masking layer 32 is not formed is etched, and the second masking layer 32 is removed to manufacture a second etched steel sheet. Thus, the etching grooves and/or logo may be formed on the steel sheet by performing the hole etching.

Figure 4:
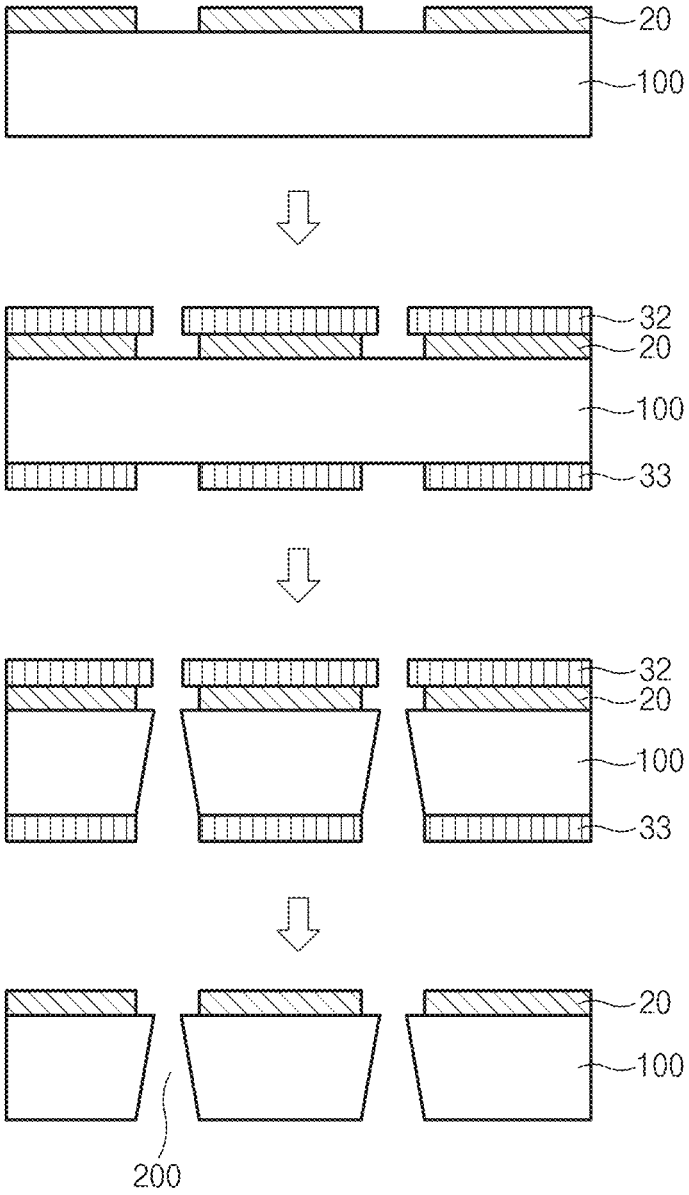
FIG. 4 is a cross-sectional view illustrating a hole etching operation according to an embodiment of the present disclosure.

Referring to FIG. 4, the second masking layer 32 may be formed on the first surface of the first etched steel sheet where the coating layer exists and a second masking layer 33 may be formed on the second surface of the first etched steel sheet. Here, a lower diameter of an exposed surface of the steel sheet on which the lower second making layer 33 is not formed is 'a' and an upper diameter of an exposed surface of the steel sheet on which the upper second masking layer 32 is not formed is 'b' (see FIG. 5).

Here, the second masking layer may be formed using a masking film that is commonly used, for example, it may be formed using a photosensitive film. In detail, the photosensitive film is attached on the first etched steel sheet and the photosensitive film is irradiated with an ultraviolet light through a mask. Therefore, one portion of the photosensitive film may remain on the coating layer to form the second masking layer and the other portion of the photosensitive film where the ultraviolet light are not irradiated through the mask may be removed to form an exposed portion of the surface of the steel sheet.

Furthermore, the etching may be to form etching grooves 200 in the steel sheet by etching the portion of the steel sheet on which the second masking layer is not formed (see FIG. 4). Here, the etching may be performed using an etching solution containing ferric chloride ($FeCl_3$).

For example, a temperature of the etching in this operation may be used without particular limitation as long as the temperature is typically applied when etching the steel sheet.

Here, each etching groove 200 may be a hole shape penetrating the steel sheet 100 in a thickness direction, a depth of the etching groove and a diameter of the hole may be adjusted depending on a concentration of the etching solution, an etching time, a thickness of the steel sheet 100, and the like. In addition, the etching groove 200 may be a variety of forms, such as a truncated cone, a polygonal truncated cone, and the like. When the etching groove 200 has a shape of the polygonal truncated cone, the "hole diameter" may be a length of a long axis of the hole or the longest distance among distances from one vertex to another vertex.

Figure 6:
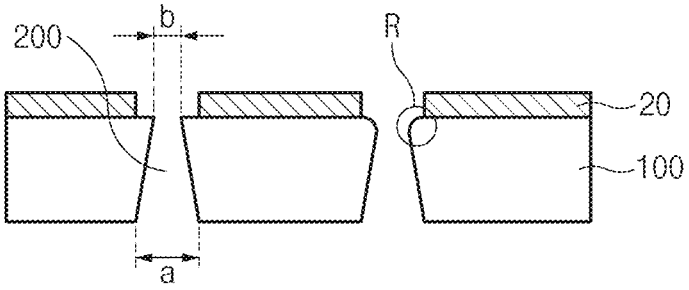
FIG. 6 is a cross-sectional view of a speaker grill for a vehicle according to an embodiment of the present disclosure.

Specifically, referring to FIG. 6, the etching groove 200 may have a truncated conical shape where a diameter at the first surface of the steel sheet 100 on which the coating layer 20 is formed is smaller than a diameter at the second surface of the steel sheet 100 on which the coating layer 20 is not formed. When the etching groove 200 has the truncated conical shape as described above, a sidewall of the etching groove 200 is not exposed, and thus a color difference between the hole sidewall and the coating layer does not occur, thereby being excellent in the appearance characteristics.

Figure 5:
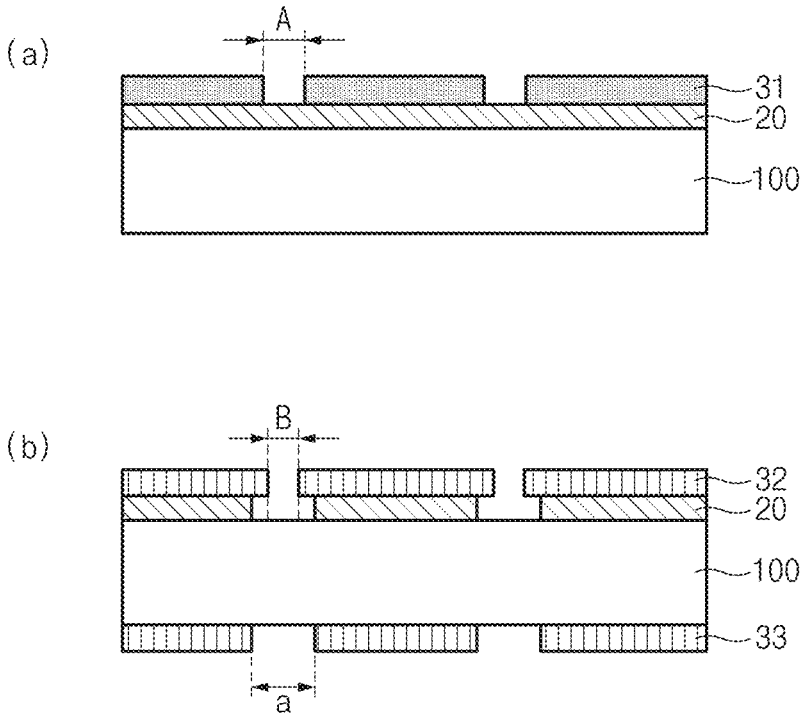
FIG. 5 shows (a) a cross-sectional view of a steel sheet on which a first masking layer is formed and (b) a cross-sectional view illustrating a steel sheet on which a second masking layer is formed, according to an embodiment of the present disclosure.

Here, in the surface of the steel sheet on which the coating layer is formed, a total area of the first masking layer is smaller than a total area of the second masking layer. In detail, an area of the coating layer on which the first masking layer is not formed may be greater than an area of the steel sheet on which the second masking layer is not formed, in one etching groove. Referring to FIG. 5, an area 'A' of the portion of the coating layer on which the first masking layer 31 is not formed may be greater than an area 'B' of the portion of the steel sheet on which the second masking layer 32 is not formed, in one etching groove. In detail, the area 'A' of the coating layer on which the first masking layer 31 is not formed may be spaced at 0.01 to 0.1 mm or 0.05 to 0.1 mm from an edge of the area 'B' of the steel sheet on which the second masking layer 32 is not formed, in one etching groove. When a distance from 'B' to 'A' is within the above range, an upper corner of the etching groove may be curved to soften touch of the surface of the speaker grill and avoid or minimize injury to a human body due to a sharp edge of the etching groove Thus, during the etching, the corner of the hole at the first surface of the steel sheet 100 on which the coating layer 20 is formed may be formed in an undercut shape (see FIGS. 5 and 6). This is because the etching solution penetrates under the second masking layer due to an area difference of the second masking layer and the coating layer during the etching to form the curved corner of the upper portion of the etching groove 200.

As described above, when the corner of the hole at the first surface of the steel sheet 100 on which the coating layer 20 is formed is curved, it is possible to minimize or avoid the sharp edge of the etching groove 200 that increases surface roughness to make the speaker grill surface rough and further avoid or minimize the human body's injury by the sharp edge.

In detail, referring to FIG. 6, in one etching groove 200, when a diameter of a target etching groove 200 is 'a', the diameter of the portion of the coating layer on which the first masking layer 31 is not formed may be set to 'b' which is greater than 'a' and the coating layer 20 may be etched to expose the portion of the steel sheet 100 (the first etched steel sheet). Thereafter, the first masking layer 31 may be removed, the second masking layer may be formed to have the diameter set to 'a', and the exposed steel sheet 100 may be etched to form the etching grooves 200.

Here, 'a' is the diameter of the etching groove 200 at the second surface of the steel sheet 100 on which the coating layer 20 is not formed and 'b' is the diameter of the etching grove 200 at the first surface of the steel sheet 100 on which the coating layer 20 is formed. For example, when the steel sheet has a thickness of 0.5 to 0.6 mm, 'b/a' may be 0.6 to 0.92, or 0.7 to 0.91. However, the diameter of 'b' may be determined in consideration of gaps between holes, rigidity of the speaker grill, and the like. When 'b/a' is within the above range, the hole sidewalls are effectively concealed depending on a line of sight.

The method of manufacturing the speaker grill for the vehicle as described above may lower the unit cost of the product by performing the coating in large amount instead of the individual coating and may lower a failure rate. In addition, the method of manufacturing the speaker grill for the vehicle may have the uniform appearance quality, may be less discoloration due to exposure of the hole sidewalls to be excellent in the appearance characteristics, may lower roughness around the etching grooves to be excellent in touch, and may form the speaker grill having the smooth spherical etching grooves.

Speaker Grill for Vehicle

Furthermore, referring to FIG. 6, the speaker grill for the vehicle according to the present disclosure includes the steel sheet 100; the metallic coating layer 20 formed on the first surface of the steel sheet 100; and the plurality of etching grooves 200 passing through the steel sheet 100.

Steel Sheet

The steel sheet 100 is a main material of the speaker grill for the vehicle and, which is not particularly limited as long as it is used to manufacture the speaker grill for the vehicle. For example, a stainless steel sheet, an aluminum steel sheet, and the like may be used as the steel sheet 100.

Coating Layer

The coating layer 20 is formed on the first surface of the steel sheet 100 to serve as implementation of the colors.

Here, the coating layer 20 may have the average thickness of 50 to 200 nm or 50 to 150 nm. When the average thickness of the coating layer 20 is within the above range, the coating layer maintains the decorative color in comparison with a coating layer having a greater thickness than the above thickness and it is easy to etch to implement the speaker hole, the logo, and the like.

Furthermore, the coating layer may include at least one selected from the group consisting of a titanium compound, a chromium compound, and a zirconium compound. In detail, the titanium compound may include at least one selected from the group consisting of TiC, TiCN, TiN, and TiAlN. In addition, the chromium compound may include at least one selected from the group consisting of CrN and TiCrN. In addition, the zirconium compound may include at least one selected from the group consisting of ZrN and ZrCN.

Etching Groove

The etching grooves 200 serve as a passage through which sound waves pass in the speaker grill for the vehicle. Here, the etching grooves 200 pass through the coating layer 20 and the steel sheet 100.

The depth of each etching groove 200 and the diameter of each hole may be adjusted by the concentration of the etching solution, the etching time, the thickness of the steel sheet 100, and the like.

Referring to FIG. 6, each etching groove 200 may have a truncated conical shape, in which the diameter of the hole at the second surface of the steel sheet 100 on which the coating layer 20 is not formed is greater than that of the hole at the first surface of the steel sheet 100 on which the coating layer 20 is formed. When the etching groove 200 has the truncated conical shape as described above, the color difference between the hole sidewalls and the coating layer 20 does not occur because the sidewalls of the etching grooves 200 are not exposed, thereby having the excellent appearance characteristics.

In addition, in a cross section of the etching groove 200, the corner of the hole at the first surface of the steel sheet on which the coating layer 20 is formed may be formed in the curved undercut shape 'R' (see FIGS. 5 and 6). As described above, when the hole at the first surface of the steel sheet on which the coating layer 20 is formed has the curved corner, it is possible to avoid or minimize the sharp edge of the etching groove 200 that increases surface roughness to make the speaker grill surface rough and further avoid or minimize the human body's injury by the sharp edge may be prevented.

In detail, referring to FIG. 6, in one etching groove 200, the etching groove 200 may have the truncated conical shape, in which the diameter 'a' of the hole at the second surface of the steel sheet 100 on which the coating layer 20 is not formed is greater than the diameter 'b' of the hole at the first surface of the steel sheet 100 on which the coating layer 20 is formed. Here, 'b/a' may be 0.6 to 0.92. When 'b/a' is within the above range, the hole sidewalls are effectively concealed depending on the line of sight to prevent discoloration.

As described above, the speaker grill for the vehicle according to the present disclosure has the uniform appearance quality, has less discoloration due to exposure of the hole sidewalls to be excellent in the appearance characteristics, lowers roughness around the etching grooves to be excellent in touch, and has the smooth spherical etching grooves.

Hereinafter, the present disclosure will be described in more detail with reference to Example. However, this Example is only for the understanding of the present disclosure, and the scope of the present disclosure in any sense is not limited to this Example.

EXAMPLE

Example 1. Manufacturing Speaker Grill for Vehicle

A coating layer was formed on a first surface of a roll-shaped stainless steel sheet (steel grade: STS 304) under an argon gas atmosphere, a temperature 90±20° C., a vacuum degree of about $10^{-6}$ torr, and an acceleration voltage of 80±10V using a sputtering physical vapor deposition to be composed of CrN and to have an average thickness of 120 nm.

Then, a first masking layer was formed on one portion of the coating layer (here, a diameter of 'A' is 2.2 mm) using a photosensitive film, the other portion of the coating layer on which the first masking layer is not formed was immersed in a first etching solution of 50° C. for 60 seconds to be etched and the first masking layer was removed (pre-etching). Here, a mixed solution of ceric ammonium nitrate $(NH_4)_2[Ce(NO_3)_6)$, perchloric acid ($HClO_4$), and water in a weight ratio of 10.9:4.25:84.85 was used as the first etching solution. Here, a perchloric acid aqueous solution of 65% of mass was used as the perchloric acid.

Then, a second masking layer was formed on the portion where the coating layer is present using the same masking film as described above (here, a diameter of 'B' is 2.0 mm), a portion of the steel sheet on which the second masking layer is not formed was etched using a ferric ($FeCl_3$) solution to form etching grooves, each of which has a truncated conical shape in a cross section of the etching groove (performing hole etching). Here, referring to FIG. 6, in one etching groove 200, a diameter 'b' of the hole at the first surface of the steel sheet 100 on which the coating layer 20 is formed was set to 2.0 mm and a diameter 'a' of the hole at the second surface of the steel sheet 100 on which the coating layer 20 is not formed was set to 2.2 mm ('b/a'=0.91).

Hereafter, the second masking layer was removed to complete the speaker grill for the vehicle.

Comparative Example 1

A speaker grill for a vehicle was manufactured in the same manner as Example 1, except that the pre-etching was not performed.

Comparative Example 2

A speaker grill for a vehicle was manufactured in the same manner as Example 1, referring to FIG. 5, except that, in one etching groove, the area 'A' of the portion of the coating layer 20 on which the first masking layer 31 is not formed was the same as the area 'B' of the portion of the steel sheet 100 on which the second masking layer 32 is not formed, and the upper diameter of the hole of the etching groove was the same as the lower diameter of the hole of the etching groove to form a cylinder shape.

Experiment Example. Appearance Characteristics Evaluation

The cross sections of the holes of the speaker grill for the vehicle manufactured by Example and Comparative Examples were observed 200 times with an optical microscope, front views and side views of appearances thereof were taken.

Figure 7:
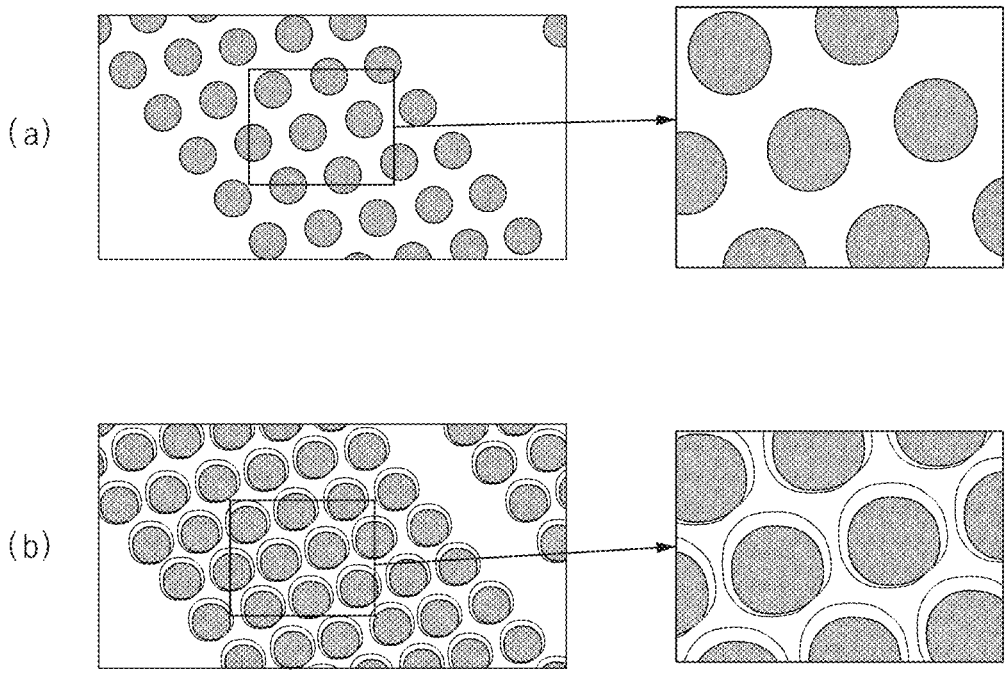
FIG. 7 shows (a) a front view and an enlarged view of a speaker grill for a vehicle of Example 1 and (b) a front view and an enlarged view of a speaker grill for a vehicle of Comparative Example 1.
Figure 8:
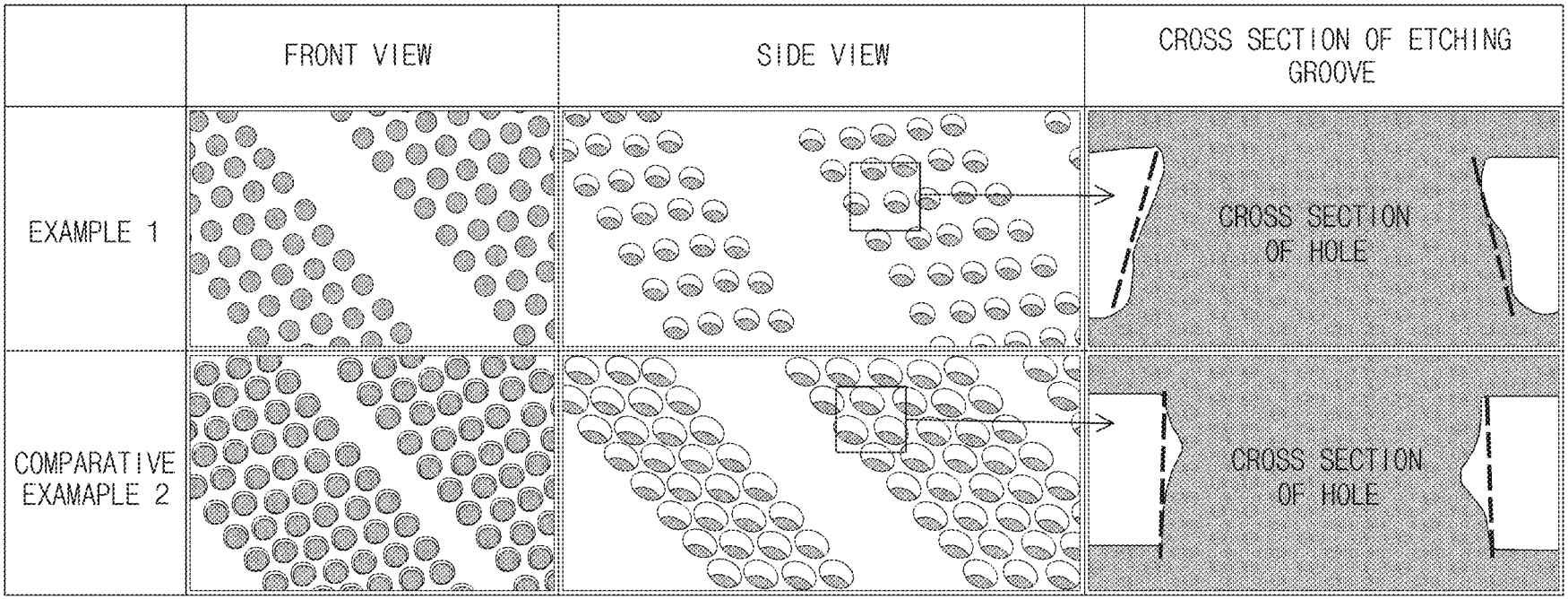
FIG. 8 is front and side views of speaker grills for a vehicle and enlarged views of hole cross-sectional views formed on the speaker grills for the vehicle according to Example 1 and Comparative Example 2.

In detail, FIG. 7 shows (a) a front view and an enlarged view of the speaker grill for the vehicle of Example 1 and (b) a front view and an enlarged view of the speaker grill for the vehicle of Comparative Example 1. In addition, FIG. 8 is front views, side views of the speaker grill for the vehicle of Example 1 and Comparative Example 2 and enlarged views of the holes of the speaker grill for the vehicle of Example 1 and Comparative Example 2. Furthermore, FIG. 9 shows (a) an enlarged view of the hole of the speaker grill for the vehicle of Example 1 and (b) an enlarged view of the hole of the speaker grill for the vehicle of Comparative Example 2.

As illustrated in FIG. 7, the speaker grill for the vehicle of Comparative Example 1 manufactured without performing of the pre-etching exhibited the etching grooves each having a non-smooth shape and the holes each having a non-uniform diameter due to the coating layer. On the other hand, the speaker grill for the vehicle of Example 1 manufactured by performing of the pre-etching exhibited the etching grooves each having a smooth shape and the holes each having a uniform diameter.

As illustrated in FIG. 8, when the speaker grill for the vehicle of Comparative Example 2 in which each etching groove is cylindrical is observed from the side, the sidewalls of the etching grooves were exposed to exhibit a discoloration between the sidewalls of the etching grooves and the coating layer. On the other hand, when the speaker grill for the vehicle of Example 1 in which each etching groove is truncated conical is observed from the side, the sidewalls of the etched grooves were not exposed, and thus there was no discoloration between the sidewalls of the etched grooves and the coating layer.

Figure 9:
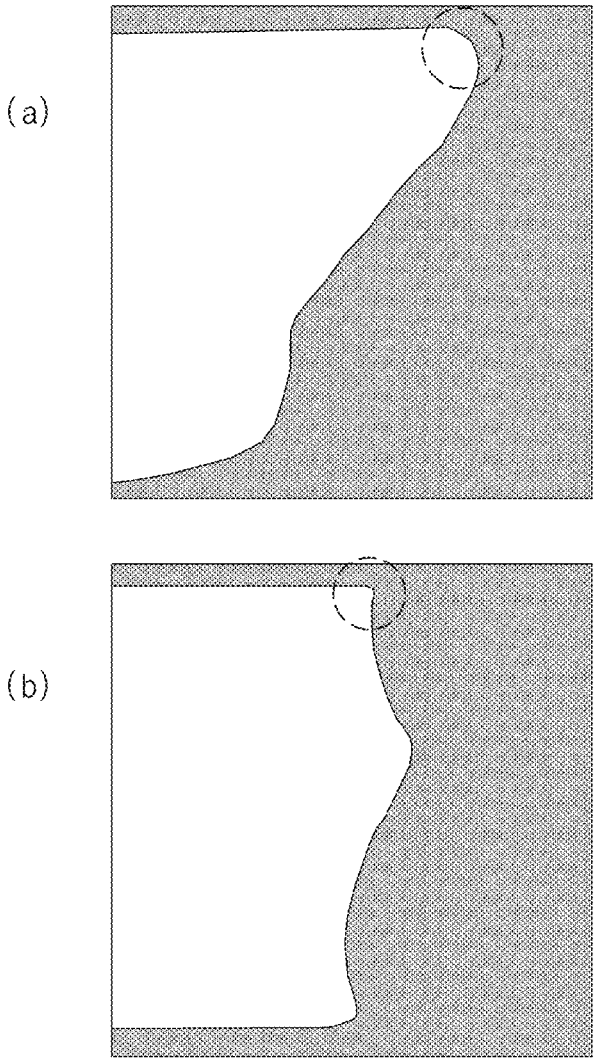
FIG. 9 shows (a) an enlarged view (200 times) of a hole cross section of a speaker grill for a vehicle of Example 1 and (b) an enlarged view (200 times) of a hole cross section of a speaker grill for a vehicle of Comparative Example 2.

As shown in FIG. 9, the corner of a top side of the etching hole of the speaker grill for the vehicle of Example 1 had the undercut shape with curvature, whereas the etching hole of the speaker grill for the vehicle of Comparative Example 2 had a sharp edge. Thus, the speaker grill of Example 1 is excellent in touch to lower the roughness around the etching holes.

As described above, the speaker grill for the vehicle according to the present disclosure was excellent in appearance quality by uniformity of the hole diameter of the etching grooves, excellent in appearance characteristics due to less discoloration due to exposure of the sidewalls of the etching grooves, and excellent in touch by the low roughness.

The method of manufacturing the speaker grill for the vehicle according to the present disclosure is capable of lowering the unit cost of the product by performing the coating in the large amount instead of the individual coating and lowering a failure rate.

In addition, the speaker grill for the vehicle according to the present disclosure has the uniform appearance quality, has less discoloration due to exposure of the hole sidewalls to be excellent in the appearance characteristics, lowers the roughness around the etching grooves to be excellent in touch, and has the smooth spherical etching grooves.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A method of manufacturing a speaker grill for a vehicle, the method comprising:

coating a coating layer by depositing metal over a first surface of a steel sheet;

pre-etching including forming a first masking layer on one portion of the coating layer, etching the other portion of the coating layer on which the first masking layer is not formed, and removing the first masking layer to form a first etched steel sheet; and performing hole etching including forming a second masking layer on one portion of the first etched steel sheet where the coating layer is present, etching the other portion of the first etched steel sheet on which the second masking layer is not formed, and removing the second masking layer to form a second etched steel sheet, wherein a total area of the first masking layer is smaller than a total area of the second masking layer.

2. The method of claim 1, wherein, the depositing is performed at a temperature of 60° C. to 120° C. and a vacuum of $1\times10^{-7}$ torr to $1\times10^{-5}$ torr.

3. The method of claim 1, wherein the coating forms the coating layer having an average thickness of 50 nm to 150 nm using a physical vapor deposition (PVD).

4. The method of claim 3, wherein the physical vapor deposition includes at least one selected from the group consisting of sputtering, E-beam evaporation, thermal evaporation, laser molecular beam epitaxial (L-MBE), and a pulse laser deposition (PLD).

5. The method of claim 1, wherein an etching in the pre-etching includes immersing the steel sheet in an etching solution having ceric ammonium nitrate, water, and a strong acid to etch the other portion of the coating layer on which the first masking layer is not formed.

6. The method of claim 5, wherein the strong acid includes at least one selected from the group consisting of nitric acid ($HNO_3$) and perchloric acid.

7. The method of claim 5, wherein the etching in the pre-etching includes immersing the steel sheet in the etching solution of 30° C. to 70° C. for 10 seconds to 100 seconds.

8. The method of claim 5, wherein the etching solution includes the ceric ammonium nitrate, the strong acid, and the water in a weight ratio of 5 to 20:2 to 6:74 to 86.

9. The method of claim 1, wherein the etching of the performing of the hole etching includes etching the other portion of the steel sheet on which the second masking layer is not formed to form etching grooves in the steel sheet.

10. The method of claim 9, wherein the etching grooves are truncated conical in which a diameter of a hole at a second surface the steel sheet over which the coating layer is not formed is greater than a diameter of a hole at the first surface of the steel sheet over which the coating layer is formed.

11. The method of claim 9, wherein a corner of the hole at the first surface of the steel sheet over which the coating layer is formed is curved in a cross section of each etching groove.

12. The method of claim 9, wherein, in one etching groove, an area of one portion of the coating layer on which the first masking layer is not formed is greater than an area of the other portion of the steel sheet on which the second masking layer is not formed.

13. A speaker grill for a vehicle comprising:

a steel sheet;

a coating layer containing metal formed over a first surface of the steel sheet; and a plurality of etching grooves passing through the coating layer and the steel sheet;

wherein each of the etching grooves is truncated conical in a cross section having a top side hole at the first surface of the steel sheet over which the coating layer is formed, and a base side hole having a greater diameter at a second surface of the steel sheet over which the coating layer is not formed, and wherein the truncated conical cross section conceals the sidewall of the etching groove.

14. The speaker grill for the vehicle of claim 13, wherein a corner of the top side hole at the first surface of the steel sheet over which the coating layer is formed is curved in a cross section of one etching groove.

* * * * *